United States Patent [19]

Lemanski

[11] 4,142,077

[45] Feb. 27, 1979

[54] BREAKER POINT ASSEMBLY

[75] Inventor: Joseph S. Lemanski, East Longmeadow, Mass.

[73] Assignee: R. E. Phelon Company, Inc., East Longmeadow, Mass.

[21] Appl. No.: 809,001

[22] Filed: Jun. 22, 1977

[51] Int. Cl.[2] ..... H01H 1/00; H01R 15/12

[52] U.S. Cl. ..... 200/19 A; 200/30 A; 200/284; 339/223 R

[58] Field of Search ..... 200/19 R, 19 A, 30 A, 200/30 AA, 31 A, 284; 339/223 R, 223 S, 269, 271, 229; 123/146.5 A

[56] References Cited

U.S. PATENT DOCUMENTS

| | | | |
|---|---|---|---|
| 2,519,976 | 8/1950 | Phelon | 200/30 A |
| 2,851,546 | 9/1958 | Phelon et al. | 200/30 A |
| 3,156,791 | 11/1964 | Hieger | 200/30 A |
| 3,419,689 | 12/1968 | Steinke | 200/19 A |
| 3,535,477 | 10/1970 | Jukes | 200/19 A |
| 3,812,305 | 5/1974 | Rees | 200/284 |

FOREIGN PATENT DOCUMENTS

| | | | |
|---|---|---|---|
| 1334189 | 6/1963 | France | 200/19 A |

*Primary Examiner*—James R. Scott
*Attorney, Agent, or Firm*—Chapin, Neal & Dempsey

[57] ABSTRACT

An improved breaker point assembly of the type including a stationary electrical contact and a pivotal breaker arm having a movable contact carried thereby. An integral breaker spring is provided for urging said contacts into engagement and for providing electrical interconnection between the movable contact, the condenser and ignition coil. One end of the integral spring is connected to the breaker arm and the other end has an inturned clamp portion to electrically engage the bared ends of lead wires and mechanically grip the insulation of the lead wires which are fitted through a hole in the inturned end portion of the breaker spring whereby the spring serves as an electrical and mechanical connector for the lead wires.

5 Claims, 4 Drawing Figures

BREAKER POINT ASSEMBLY

BACKGROUND

In mechanically operated breaker point mechanisms, a breaker spring is employed to urge a movable breaker point into electrical contact with a stationary breaker point and provides means of electrically interconnecting the ignition coil and condenser with the breaker points. In the prior art, each lead wire from the condenser and ignition coil is provided with a separate connector secured to a single terminal by which the breaker spring is attached to the breaker point housing. Examples of such constructions are found in U.S. Pat. Nos. 2,851,546 to Phelon et al. and 2,820,856 to Krueger. Although such mechanisms effectively maintain the electrical connections between the ignition components and the breaker spring, it is highly desirable to minimize the number of parts required for this purpose with a view to economy and ease of manufacture and assembly.

The principal object of this invention is to provide an improved breaker assembly which overcomes the deficiencies of the prior art.

It is another object of the present invention to provide an improved breaker assembly wherein electrical and mechanical connection to the breaker points is accomplished solely by the breaker spring per se, no separate connector being required.

BRIEF DESCRIPTION OF THE DRAWINGS

These and other objects will become more readily apparent from the following detailed description taken in connection with the accompanying drawings in which.

DESCRIPTION OF THE PREFERRED EMBODIMENT

Figure 1:
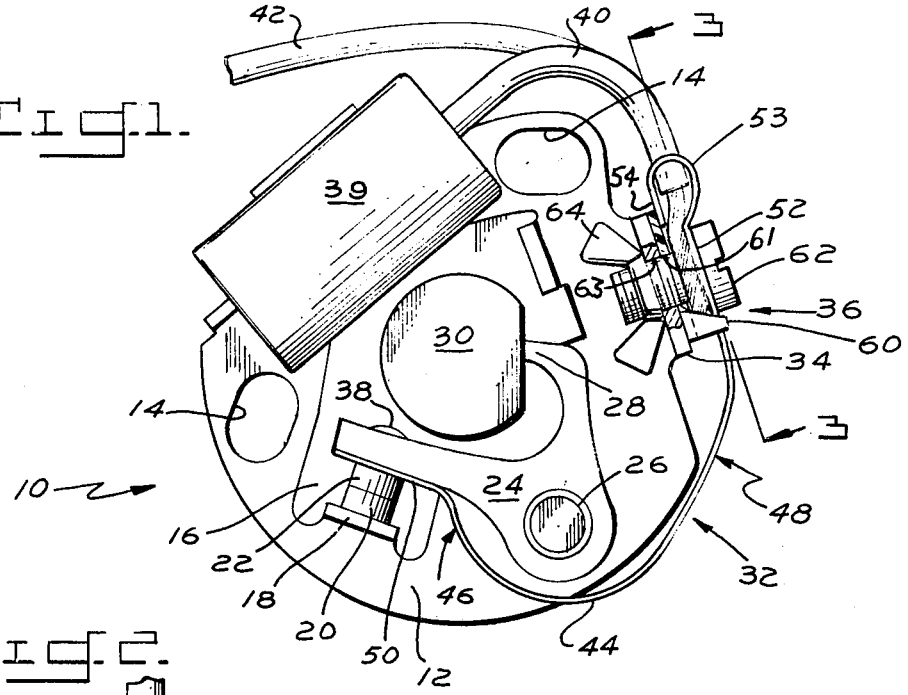
FIG. 1 is a top plan view partially broken away of the improved breaker assembly of the present invention.

Referring to the drawings, and in particular to FIG. 1, the improved breaker assembly of the present invention is shown generally at 10 and comprises a mounting plate 12 having a number of elongated apertures 14 to receive screws or other suitable fasteners (not shown) for affixing the plate to a magneto or distributor housing. A bracket 16 is fixed to plate 12 and includes an upstanding plate or post 18 on which stationary electrical contact 20 is mounted. A movable contact 22 is carried by a breaker arm 24 which pivots about a post 26 which extends upwardly of the mounting plate 12. Breaker arm 24 includes a cam follower portion 28 which contacts a rotary cam 30. As will be appreciated, rotation of cam 30 will cause breaker arm 24 to pivot to open and close the breaker points. The points will be opened when cam follower 28 is riding on the lobe or curved surface of cam 30.

The breaker assembly includes a unitary breaker spring 32 attached at one end there of to upstanding bracket or plate 34 of terminal 36. Breaker spring 32 is also affixed to the outer end of breaker arm 24 and is electrically connected to movable contact 22 by any suitable fastener means such as rivet 38. Breaker spring 32 urges the cam follower 28 against cam 30 and the contact points are maintained closed until the lobe on cam 30 pivots breaker arm 24 in a clockwise direction as viewed in FIG. 1. A capacitor or condenser 39 is electrically connected to movable breaker point 22 by insulated lead wire 40 and metallic breaker spring 32. Similarly another lead wire 42 connects the ignition coil (not shown) to movable contact 22 by way of spring 32. While particular embodiments of the breaker points, breaker arm, mounting plate, bracket and capacitor have been shown, it will be understood that these components are merely illustrative of the environment of the present invention and not limitative of its scope.

Figure 2:
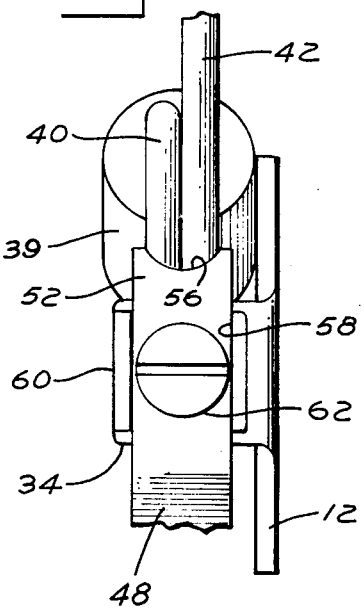
FIG. 2 is an elevated side view of the improved breaker assembly of the present invention.
Figure 3:
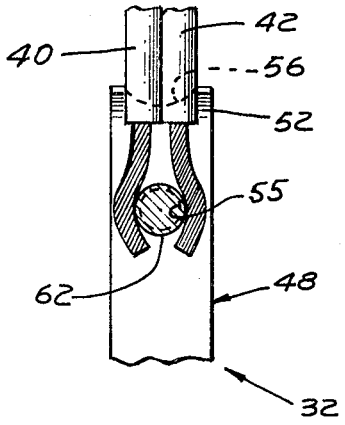
FIG. 3 is a fragmentary sectional view taken along line 3—3 of FIG. 1.
Figure 4:
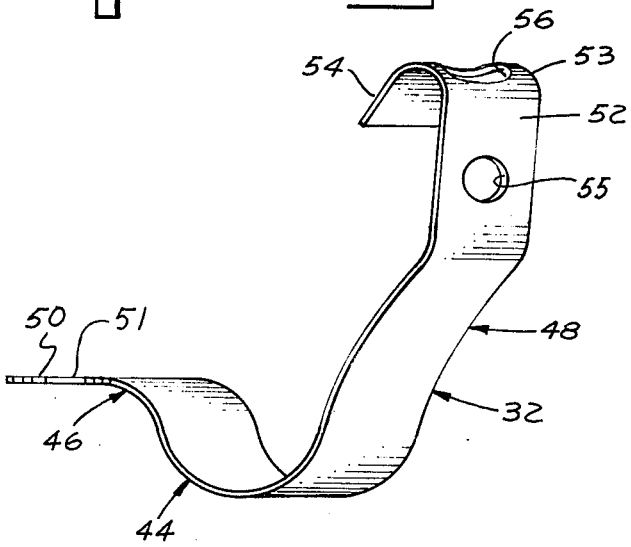
FIG. 4 is a perspective view partially in section of a breaker spring employed in the improved breaker assembly of the present invention.

As best seen in FIGS. 1 and 4, breaker spring 32 is a unitary metallic ribbon or leaf spring which includes a curved central portion 44 and two outwardly extending arm portions 46 and 48. The spring is preferably of a spring steel such as #302 stainless steel and in the preferred embodiment is approximately 0.312 inch in width and 0.0185 inch in thickness. Arm portion 46 terminates in a generally straight terminal end portion 50 which is apertured at 51 to receive therethrough a rivet 38 for connecting one end of the spring to breaker arm 24 and holding the spring in electrical contact with breaker point 22. The other arm 48 of the spring includes a generally straight section 52, a reversibly curved section 53 and a generally straight terminal section 54 which extends inwardly forming an oblique angle relative to straight section 52 of the spring. Section 52 is provided with an aperture or hole 55 adapted to receive a suitable fastener for connecting arm 48 of the spring at the breaker housing. The curved section 53 of the spring is also provided with an aperture or hole 56 of generally oval shape having its larger dimension disposed transversely to the spring. The hole 56 is adapted to receive therethrough in side-by-side abutting relation the outer diameters of insulated lead wires 40 and 42, as shown in FIGS. 2 and 3.

The clamping portion of the breaker spring is adapted to be mounted on bracket 34 of terminal 36 by means of a terminal block 60 of electrically non-conductive material, such as synthetic plastic. As shown, the block 60 includes upstanding side rails 58 forming a U-shaped channel in the upper surface of the block. The block is provided with a centrally located aperture 61 and a threaded fastener, such as bolt 62, is screwed through aperture 61 which may be threaded or self-threading for fastening the assembly together. Alternatively, the assembly may be fastened together as shown in FIG. 1 by a nut 64 fabricated of electrically non-conductive material such as a suitable synthetic plastic for example Nylon. In assembling the breaker point mechanism embodying this invention, the ends of lead wires 40 and 42 are stripped of insulation for a short distance from their ends. The bared ends of the lead ends 40 and 42, FIG. 3, are then fitted through the oval aperture 56 from the convex side of the curved section of the breaker spring 32. The insulated portions of the lead wires are positioned within the oval aperture 56 and the straight section 52 of breaker spring 32 may then be fitted into the channel 58 of the terminal block 60. The bolt 62 is then inserted through aperture 55 in the spring 32 between the bared ends of the lead wires 40 and 42, which as shown in FIG. 3, are conveniently arranged on opposite sides of the bolt. The bolt also extends through an aperture 63 in terminal bracket 34 of sufficient diameter so that the bolt will not contact the metallic bracket and short out the connection.

The inturned end 54 of the spring 32 is placed within the channel 58 of the terminal block 60 underlying the ends of the lead wires and when the bolt 62 is screwed into the threaded hole 61 in the block, the bared ends of the lead wires are firmly clamped between the inner surface of spring section 52 and the outer surface of the block 60. Alternatively or additionally, nut 64 may be screwed onto the outer end of the bolt 62. These arrangements insure good electrical contact of the lead wires and the spring 32. In addition, tightening of the bolt 62 causes the inturned end of the breaker spring to be clamped down, as shown in FIG. 1, whereby the oval aperture 56 is flattened in cross section and thus tightly clamps and grips the insulation of the lead wires to hold the same securely in place without danger of being dislodged in normal usage of the assembly. In addition, the electrical insulating properties of the nut and terminal block prevent the short circuiting of the electrical connection between breaker points, condenser and coil by contact of the spring and mounting plate.

As described above, breaker spring 32 functions to urge breaker points 20 and 22 into contact with each other and to electrically connect the points to condenser 38 and the ignition coil by way of wires 40 and 42. As further noted above, the connection of such electrical components to the breaker spring has in the past required a separate connector secured to each such electrical lead thus adding significantly to both material cost and assembly time as compared with the breaker point assembly embodying this invention. Moreover, these economies are achieved in a highly reliable product which insures positive electrical and strong mechanical connection of the breaker points to the other electrical components of an ignition system.

While there has been shown and described a specific embodiment of the improved breaker assembly of the present invention, it will be understood that modifications may be made without departing from this invention and it is intended by the appended claims to cover such modifications as fall within the true spirit and scope of this invention.

Having thus described the invention, what is claimed is:

1. In a breaker point assembly of the type including a stationary contact and a pivotable breaker arm carrying an electrical contact for periodic make and break contact with said stationary contact, the improvement comprising:

a unitary breaker spring of spring steel having a curved intermediate portion with two arm portions extending outwardly therefrom, one arm portion being connected to the breaker arm and the other arm portion including an inturned clamp section adapted to receive and retain therein at least one electrical lead for mechanical and electrical connection therewith and means for holding said clamp section in gripping relation on the insulation of said lead and maintaining the conductor wire of said lead in electrical contact with said breaker spring.

2. In a breaker point assembly as set forth in claim 1 wherein said clamp section of the breaker spring includes a curved bight portion, one terminal end of said spring extending therefrom and forming a generally U-shaped end portion, an aperture extending through said curved bight section and being dimensioned to receive therein the insulated diameter of a pair of electrical leads disposed in side-by-side relation, said aperture serving to grip said insulated leads when the U-shaped end portion of the spring is clamped together.

3. In a breaker point assembly as set forth in claim 2 in which said assembly includes a terminal bracket and means for holding said clamp section which comprises a terminal block of electrically non-conductive material adapted to receive the clamp section of said breaker spring with the terminal end of said clamp section disposed inwardly against said block and a fastener for attaching said clamp section to said block with the opposed inner surfaces of said U-shaped end portion urged into surface-to-surface engagement with opposite surfaces of the portion of said lead wires fitted through said aperture, said terminal block preventing shorting to said bracket of the electrical connection between said spring and said lead wires.

4. In a breaker point assembly as set forth in claim 3 in which said aperture is generally oval in cross section with its longer dimension disposed transversely of said spring, said spring and block each including holes registrable to receive a threaded fastener for holding said block, the clamp section of said spring and said lead wires in assembled relation on said breaker point assembly when said threaded fastener is screwed into the hole in said block.

5. In a breaker point assembly as set forth in claim 3 in which an electrically non-conductive nut is screwed onto said threaded fastener which extends through aligned holes in said block and said bracket for retaining the breaker spring, lead wires and block in assembled relation on said bracket.

* * * * *